US010549901B2

(12) United States Patent
Yamamoto et al.

(10) Patent No.: US 10,549,901 B2
(45) Date of Patent: Feb. 4, 2020

(54) DOUBLE CONTAINER

(71) Applicants: Atsugi Plastics Co., Ltd., Tokyo (JP); Toyo Suisan Kaisha, Ltd., Tokyo (JP)

(72) Inventors: Kazuo Yamamoto, Tokyo (JP); Toshihiro Nakajima, Kameoka (JP)

(73) Assignee: Atsugi Plastics Co., Ltd., Tokyo (JP)

( * ) Notice: Subject to any disclaimer, the term of this patent is extended or adjusted under 35 U.S.C. 154(b) by 161 days.

(21) Appl. No.: 15/792,426

(22) Filed: Oct. 24, 2017

(65) Prior Publication Data

US 2018/0111743 A1 Apr. 26, 2018

(30) Foreign Application Priority Data

Oct. 25, 2016 (JP) ..... 2016-208572

(51) Int. Cl.
*B65D 81/38* (2006.01)

(52) U.S. Cl.
CPC ..... *B65D 81/3869* (2013.01)

(58) Field of Classification Search
CPC ..... B65D 81/3869; B65F 2210/1815
USPC ..... 220/549, 636, 638, 592.2
See application file for complete search history.

(56) References Cited

U.S. PATENT DOCUMENTS 5,226,558 A * 7/1993 Whitney ..... B65D 25/38 206/386
6,439,418 B1 * 8/2002 Immerman ..... B65D 25/24 220/626
9,004,309 B1 * 4/2015 Gardner ..... B01F 15/00733 220/495.01
9,521,919 B1 * 12/2016 Reyes ..... A47G 29/093
2009/0045194 A1 2/2009 Rhee
2015/0008226 A1 * 1/2015 Dotson ..... B65F 1/141 220/495.06

(Continued)

FOREIGN PATENT DOCUMENTS

JP S46-033432 Y 11/1971
JP S56-166232 U1 12/1981

(Continued)

OTHER PUBLICATIONS

Japanese Office Action, Japanese Application No. 2016-208572, dated Oct. 31, 2017, 7 pages.

(Continued)

*Primary Examiner* — Shawn M Braden
(74) *Attorney, Agent, or Firm* — Fenwick & West LLP

(57) ABSTRACT

Provided is a double container in which an inner container and an outer container are difficult to be separated in a case where the inner container is attached to the outer container. It is a cup-shaped double container, having an inner container and an outer container in which a part of a cross section are non-circular, having a space provided between the inner container and the outer container, and having an open upper end portion, the container including: on an outer peripheral surface of a cylindrical side surface member of the inner container, a rib extending in a vertical direction and disposed in plural numbers at predetermined intervals; and a rotation regulating unit disposed on an inner peripheral surface of a cylindrical side surface member of the outer container and capable of regulating relative rotation of the inner container and the outer container by interfering with the rib.

8 Claims, 6 Drawing Sheets

(56) References Cited

U.S. PATENT DOCUMENTS

| | | | | |
|---|---|---|---|---|
| 2016/0007781 | A1* | 1/2016 | DeNinno ..... | A47G 19/2227<br>206/457 |

FOREIGN PATENT DOCUMENTS

| | | | |
|---|---|---|---|
| JP | H04-102272 | U1 | 9/1992 |
| JP | H05-007631 | U | 2/1993 |
| JP | 2545154 | Y | 5/1997 |
| JP | 2004-244075 | A | 9/2004 |
| JP | 2013-028399 | A | 2/2013 |

OTHER PUBLICATIONS

Japan Patent Office, Notification of Reasons for Refusal, JP Patent Application No. 2017-245456, dated Oct. 23, 2018, five pages.

* cited by examiner

DOUBLE CONTAINER

CROSS-REFERENCE TO RELATED APPLICATIONS

This application claims the benefit of, and right of priority to, Japanese Patent Application No. 2016-208572, filed Oct. 25, 2016, which is hereby incorporated by reference in its entirety.

BACKGROUND

Field of Art

The present invention relates to a cup-shaped double container including an inner container and an outer container, and further particularly relates to a double container having a heat insulating effect by a space formed between the inner container and the outer container.

Description of the Related Art

Conventionally, there is known a cup-shaped double container having a double structure of an inner container and an outer container and having a heat insulating effect by a space formed between the containers. In this type of the double container, after the inner container is attached to the outer container, a part of each of the containers is welded together. Note that, for the purpose of simplification of a production process, a technology of omitting a welding process has been examined, and as such a technology, there is known a technology disclosed in, for example, Japanese Utility Model Registration No. 2545154.

In this Japanese Utility Model Registration No. 2545154, there is provided a plurality of side-projecting portions extending in a vertical direction, from an upper part of an outer peripheral surface of the inner container to the vicinity of a bottom part. Note that the side-projecting portions are constituted to be brought into contact with an inner peripheral surface of the outer container in a case where the inner container is attached to the outer container. Furthermore, a radial bottom-projecting portion is provided on a bottom surface member on an inner side of the outer container, an annular bottom-projecting portion is provided on the bottom surface member on an outer side of the inner container, and the two bottom-projecting portions are constituted to be brought into contact with each other in a case where the inner container is attached to the outer container. Accordingly, in a case where the inner container and the outer container are relatively rotated, rotation is made difficult by a friction force generated between the side-projecting portions and the inner peripheral surface of the outer container and by a friction force generated between the two bottom-projecting portions. Note that, in Japanese Utility Model Registration No. 2545154, rotation can be suppressed by bringing the side-projecting portions formed by extending the bottom-projecting portion of the outer container to a side-surface member into contact with the side-projecting portions of the inner container.

SUMMARY

However, with the technology disclosed in Japanese Utility Model Registration No. 2545154, since the rotation is suppressed by the friction force of the portions in contact, rotation occurs relatively easily in a case where a human hand or the like is applied. Note that relative rotation of the inner container and the outer container can be suppressed by bringing the side-projecting portions provided at the inner container and the outer container into contact with each other. However, since a predetermined interval is provided between the respective adjacent side-projecting portions, rotation is possible within a range according to the predetermined interval.

In addition, regarding the double container, various shapes have been proposed from the viewpoints of differentiation from the other products, designability and the like, and the shapes are diversified in that, for example, a shape of an opening and a shape of a bottom surface member are different from each other. Accordingly, in a cup-shaped double container formed by expanding from the bottom surface member to the opening portion, in a case where the opening portion or the bottom surface member has a non-circular shape, for example, an elliptic shape or a substantially polygonal shape, in combination with the fact that this type of container generally has a shape expanded toward an upper side, relative rotation of the inner container and the outer container generates a force in a direction in which the inner container floats from the outer container (separating direction) by interference between the both. Accordingly, the inner container and the outer container are relatively easily separated by the relative rotation of the outer container and the inner container.

The present invention has been made in view of the various problems of the conventional technology as described above and has an object to provide a double container in which the inner container and the outer container are hardly separated even without welding in a case where the inner container is attached to the outer container.

In order to achieve the aforementioned object, the double container according to the present invention is a double container in a cup shape, having an inner container in which at least a part of a cross section is non-circular and an outer container in which at least a part of a cross section is non-circular, having a space provided between the inner container and the outer container, and having an open upper end portion, the container including: on an outer peripheral surface of a cylindrical side surface member of the inner container, a rib extending in a vertical direction and disposed in plural numbers at predetermined intervals; and a rotation regulating unit disposed on an inner peripheral surface of a cylindrical side surface member of the outer container and capable of regulating relative rotation of the inner container and the outer container by interfering with the rib, wherein the relative rotation of the inner container and the outer container is regulated by the rotation regulating unit within a range where a force in a separating direction of the inner container and the outer container is not generated by the interference between the both.

In the present invention, in a case where the rib formed at the inner container interferes with the rotation regulating unit formed on the outer container, the relative rotation of the inner container and the outer container is regulated within the range where there is not generated the force in the separating direction of the inner container and the outer container by the interference between the both, and thus the inner container and the outer container cannot be separated easily once they are attached together. Furthermore, for example, even in a case of a taper shape expanding toward the opening portion, the inner container and the outer container cannot be rotated easily, and thus the inner container and the outer container become hardly separated.

Further features of the present invention will become apparent from the following description of exemplary embodiments (with reference to the attached drawings).

DETAILED DESCRIPTION

Figure 1A:
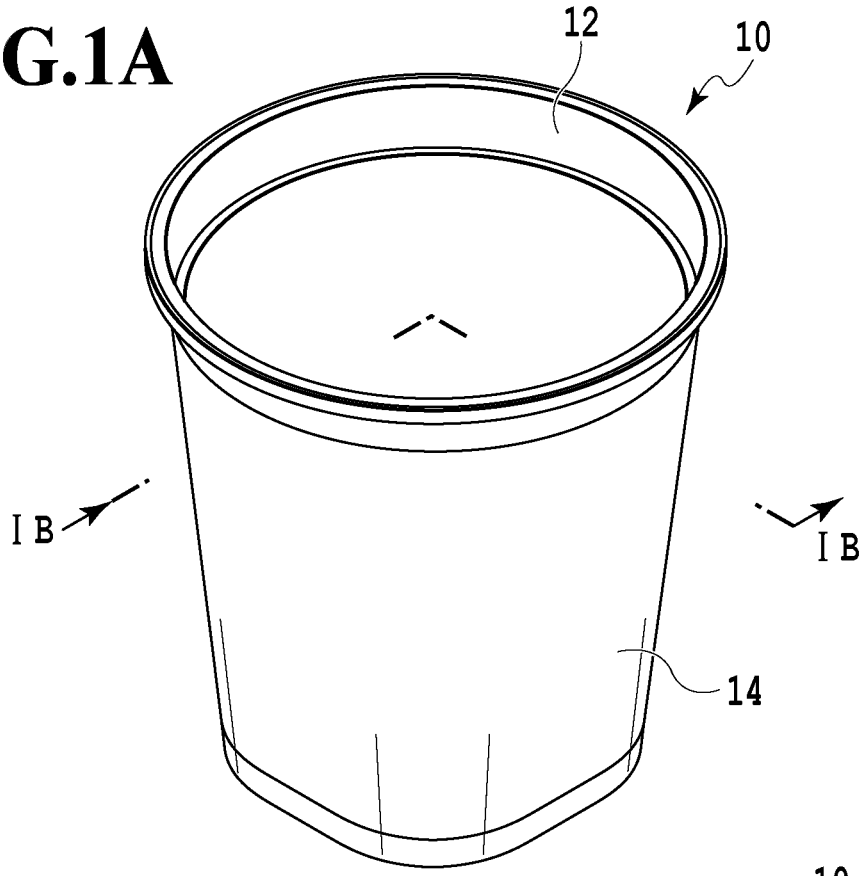
FIG. 1A is a schematic configuration perspective view of a double container according to the present invention.
Figure 1B:
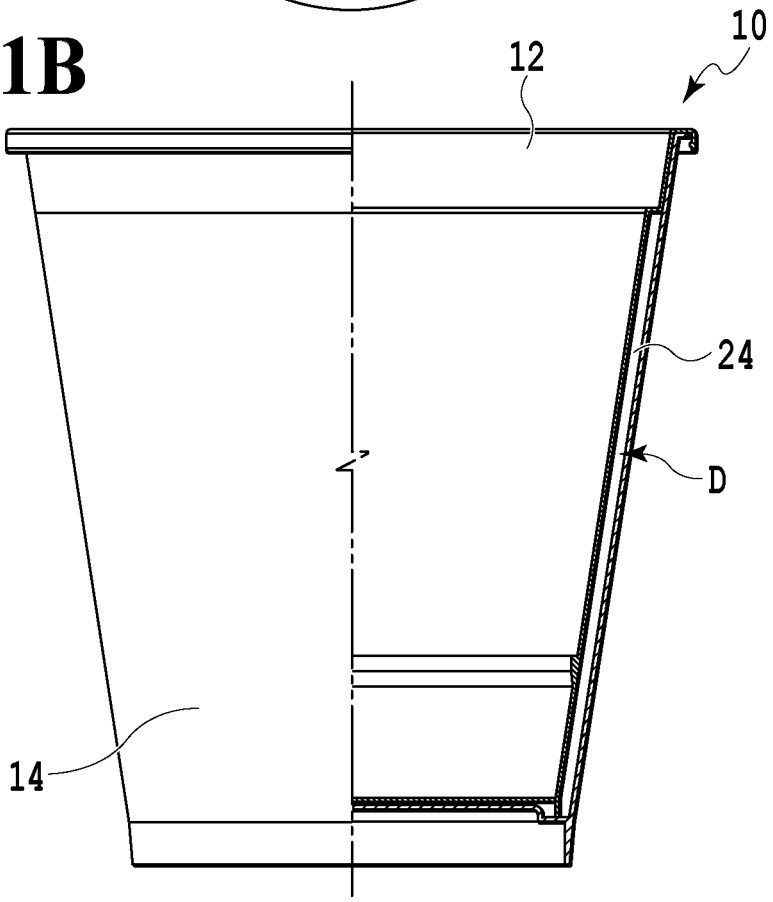
FIG. 1B is a IB-IB line cross-sectional view in FIG. 1A.

Hereinafter, an example of a double heat-insulating container according to the present invention will be described in detail with reference to the attached drawings. A double container 10 illustrated in FIGS. 1A and 1B is a cup-shaped container capable of storing a liquid therein and is constituted by an inner container 12 and an outer container 14 formed having cup shapes, and has a double structure in which a space D is formed between the inner container 12 and the outer container 14. The inner container 12 includes a side surface member 12*c* formed of a cylindrical plate material and has an opening portion 12*a* opened upward and a bottom surface member 12*b* closed downward. The outer container 14 includes a side surface member 14*c* formed of a cylindrical plate material and has an opening portion 14*a* opened upward and a bottom surface member 14*b* closed downward.

Figure 2A:
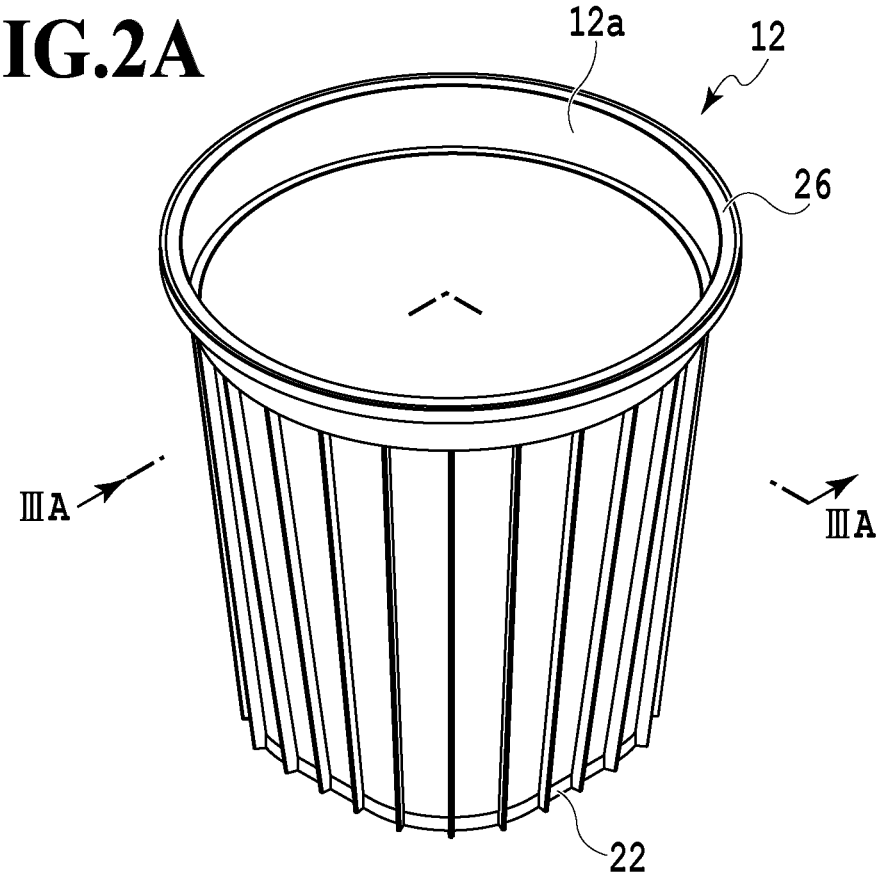
FIG. 2A is a schematic configuration perspective view of an inner container.
Figure 2B:
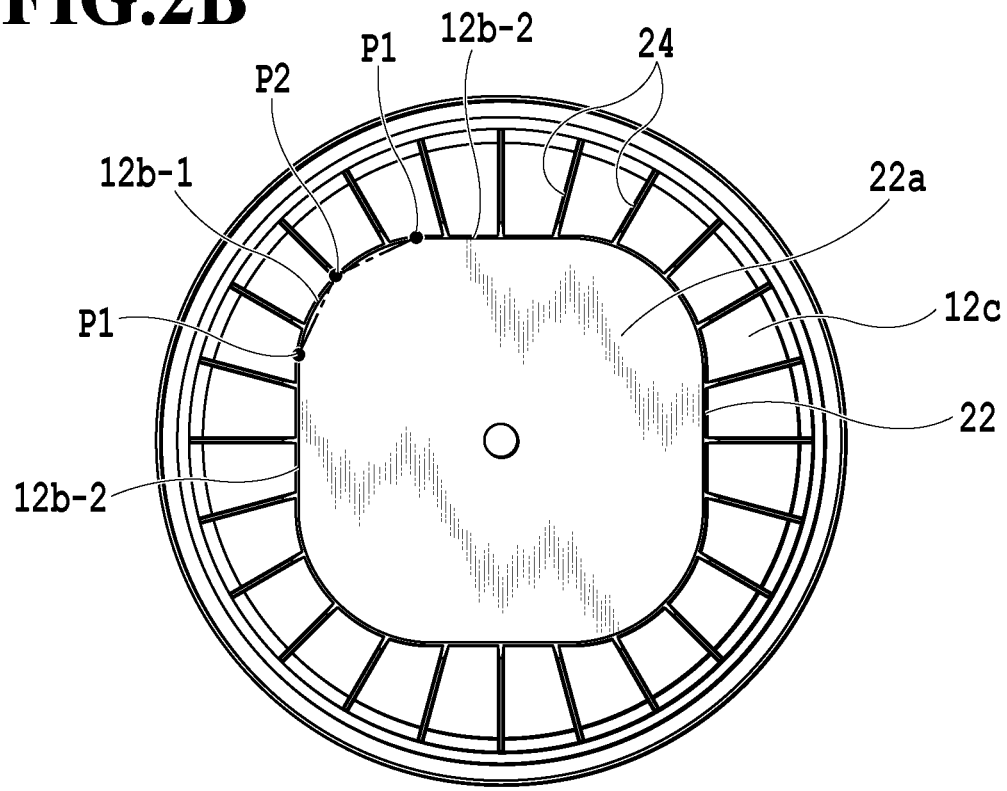
FIG. 2B is a bottom view of the inner container.
Figure 3A:
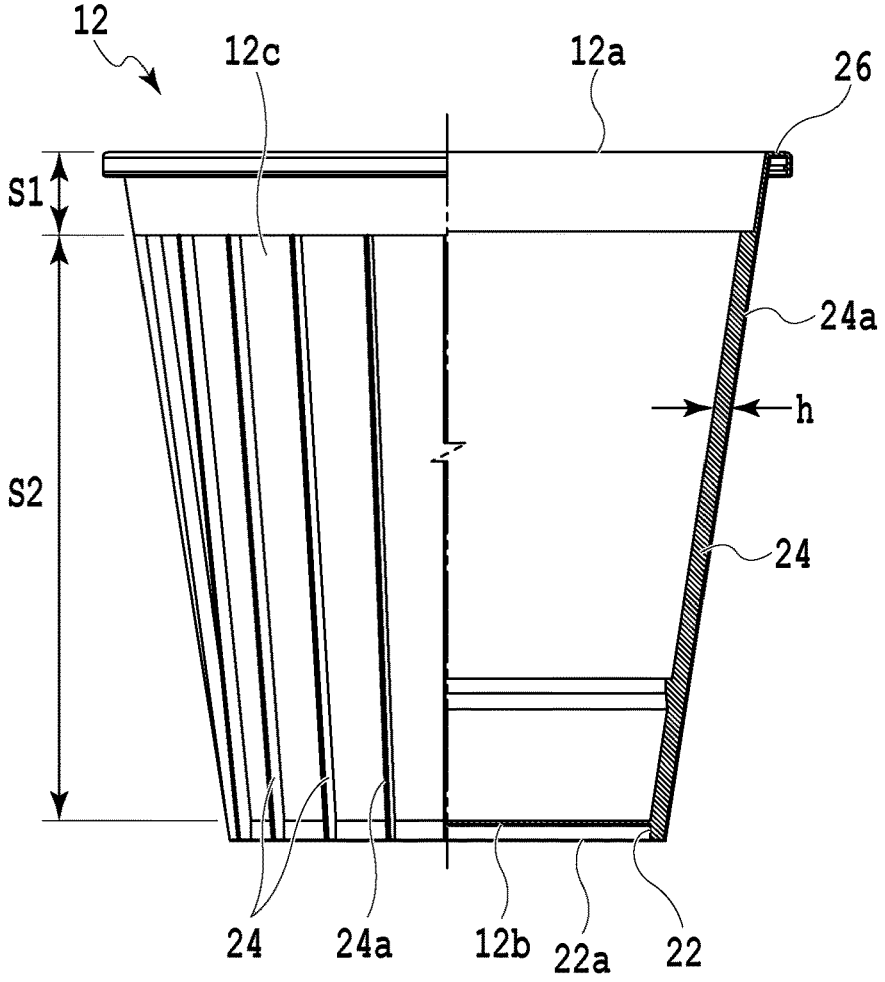
FIG. 3A is a IIIA-IIIA line cross-sectional view in FIG. 2A.

The inner container 12 has a cup shape in which the opening portion 12*a* formed on an upper side (one side) of the cylindrical side surface member 12*c* is larger than the bottom surface member 12*b* formed on a lower side (the other side), and the side surface member 12*c* has a tapered cup shape and is formed of a resin material such as polypropylene (refer to FIGS. 2A and 3A). The opening portion 12*a* is circularly opened, and the bottom surface member 12*b* is formed having a substantially rectangular shape with four arc-shaped corner parts (refer to FIG. 2B). On the bottom surface member 12*b*, there is provided a bottom-projecting portion 22 protruding in a direction perpendicular to the bottom surface member 12*b* along an outer periphery of its lower surface. Accordingly, at a lower end part of the inner container 12, there is formed an opening portion 22*a* having a substantially rectangular shape formed by the bottom-projecting portion 22. Furthermore, in the side surface member 12*c* of the inner container 12, in a case where the inner container 12 is attached to the outer container 14, there are formed an approaching region S1 with its outer peripheral surface approaching the inner peripheral surface of the outer container 14 and capable of contact and a separating region S2 separating incapable of contact.

On the outer peripheral surface of the side surface member 12*c*, a rib 24 extending from the separating region S2 to the bottom-projecting portion 22 is disposed in plural numbers at predetermined intervals. Namely, the rib 24 is extended in the vertical direction along the outer peripheral surface of the side surface member 12*c* and is formed having a height h. Note that the vertical direction in the present embodiment is a direction in a case where the inner container 12 is inserted into the outer container 14 and is a direction crossing the opening portions 12*a* and 14*a* and the bottom surface members 12*b* and 14*b*. At this time, an upper end portion of the rib 24 is positioned on a lower end portion of the approaching region S1 in the side surface member 12*c*, and a lower end portion of the rib 24 is formed so as to be positioned to the lower end portion of the bottom-projecting portion 22 of the side surface member 12*c*. Accordingly, in the case where the inner container 12 is attached to the outer container 14, the approaching region S1 of the side surface member 12*c* in the inner container 12 is brought into contact with the inner peripheral surface of the outer container 14 and an end surface 24*a* of the rib 24 is brought into contact with the inner peripheral surface of the outer container in the separating region S2 in the side surface member 12*c*. Note that the rib 24 is disposed in plural numbers at the predetermined intervals on the outer peripheral surface of the side surface member 12*c* as described above. The ribs 24 are preferably disposed at least at four places at positions each passing through a central part of each of the arc shapes of the bottom surface member 12*b*. Note that the central part of the arc shape in the bottom surface member 12*b* is a point P2 on a curved line portion 12*b*-1 at an equal distance from connection points P1 between the curved line portion 12*b*-1 of an arc shape and two adjacent straight line portions 12*b*-2, in the bottom surface member 12*b* having a substantially rectangular shape.

Figure 3B:
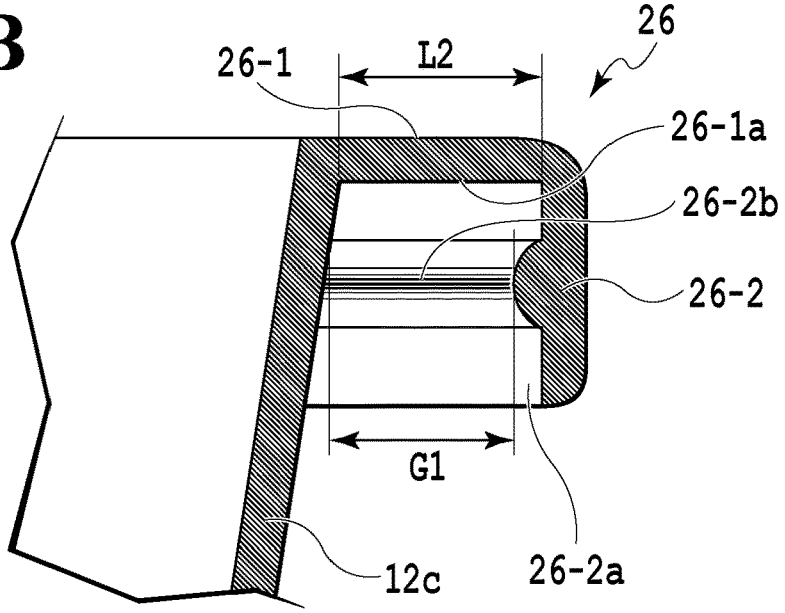
FIG. 3B is a cross-sectional view in the vicinity of a flange portion in the inner container.

On the opening portion 12*a*, a flange portion 26 is provided around an opening edge. This flange portion 26 is constituted by an extension portion 26-1 extended toward an outer side in a radial direction of the opening and an extension portion 26-2 extended to a lower side at a distal end of the extension portion 26-1 (refer to FIG. 3B). The opening portion 12*a* is reinforced around the opening edge, by this flange portion 26. Furthermore, on the extension portion 26-2, there is formed a convex portion 26-2*b* protruding toward the side surface member 12*c* side on an inner surface 26-2*a* facing the side surface member 12*c*. In a case where the inner container 12 is to be attached to the outer container 14, a flange portion 36 (which will be described later) of the outer container 14 is fitted into this flange portion 26 (namely, in a region surrounded by the side surface member 12*c* and the extension portions 26-1 and 26-2), and the flange portion 36 is brought into a contact state with an inner surface 26-1*a* of the extension portion 26-1 (refer to FIG. 5B).

Figure 4A:
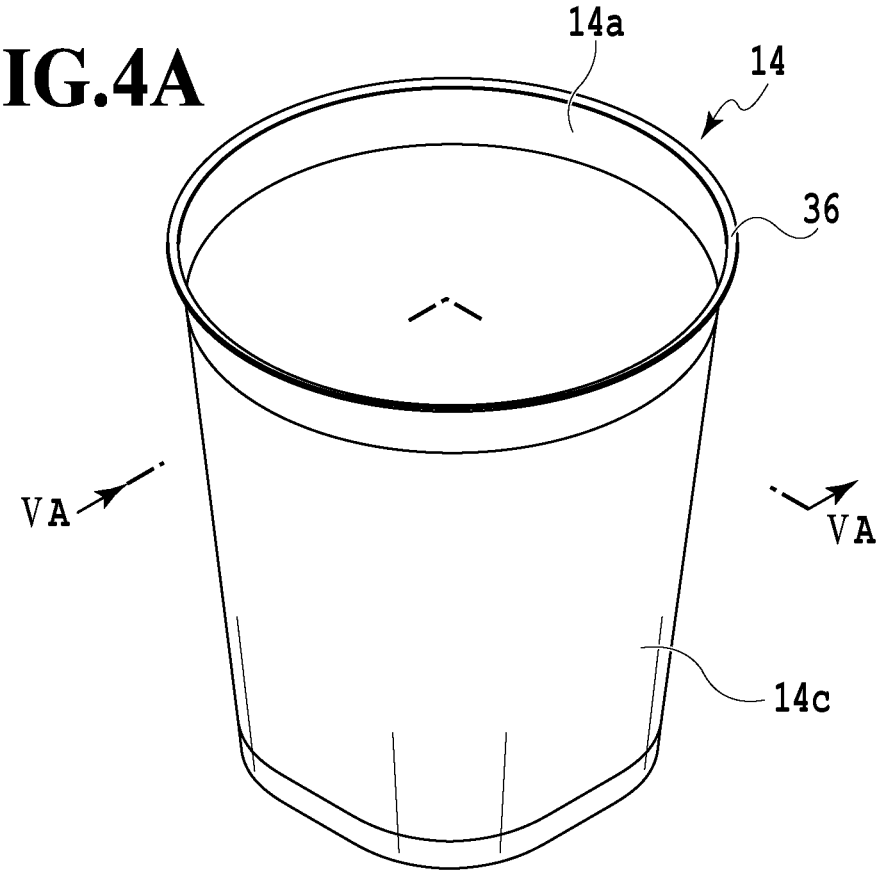
FIG. 4A is a schematic configuration perspective view of an outer container.
Figure 4B:
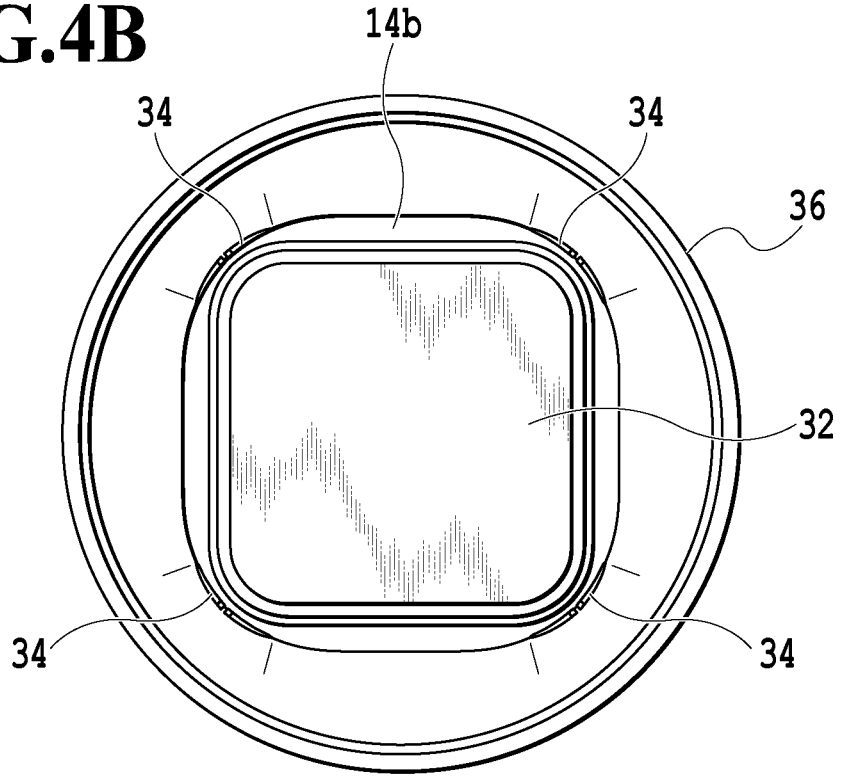
FIG. 4B is a plan view of the outer container.
Figure 5A:
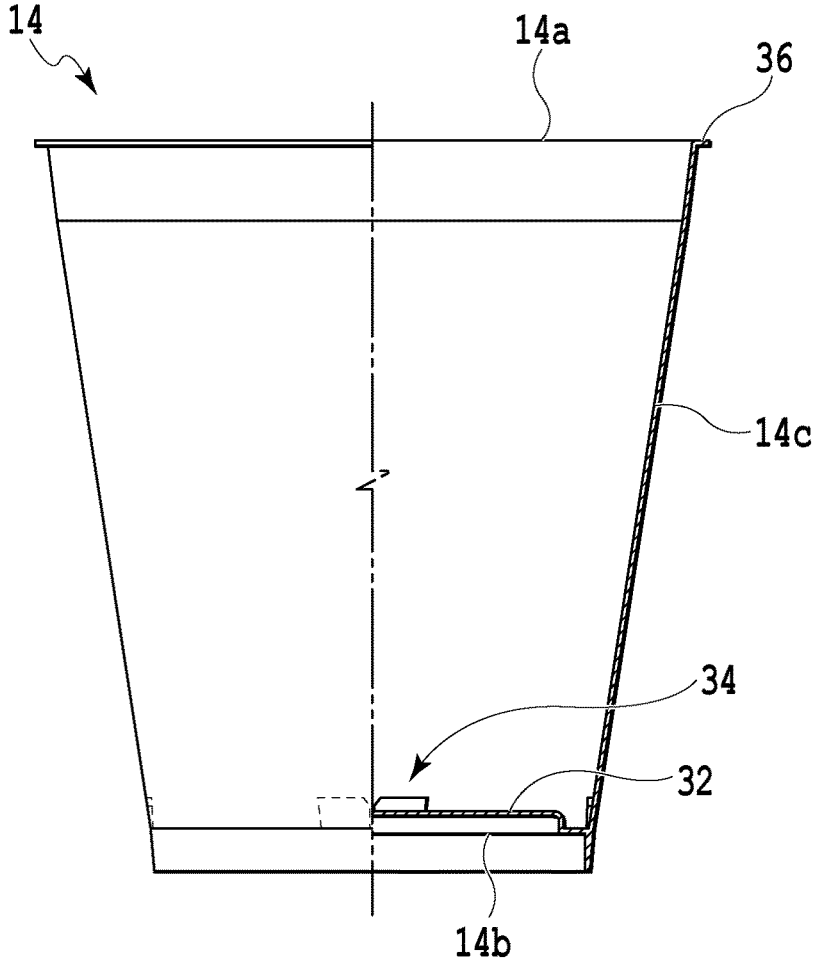
FIG. 5A is a VA-VA line cross-sectional view in FIG. 4A.
Figure 5B:
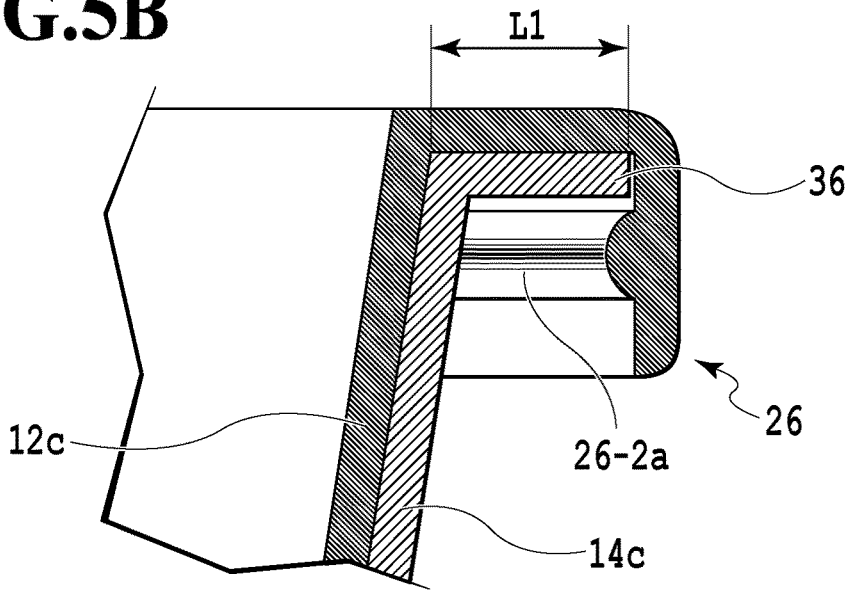
FIG. 5B is a cross-sectional view in the vicinity of the flange portion in a case where the inner container is attached to the outer container.

Furthermore, similarly to the inner container 12, the outer container 14 has a cup shape in which the opening portion 14*a* formed on the upper side of the cylindrical side surface member 14*c* is larger than the bottom surface member 14*b* formed on the lower side and the side surface member 14*c* has a taper shape, and is formed of a resin material such as polypropylene (refer to FIGS. 4A and 5A). The opening portion 14*a* is circularly opened, and the bottom surface member 14*b* is formed having a substantially rectangular shape in which each of four arc-shaped corner parts has a substantially rectangular shape (refer to FIG. 4B). On an inner side of the upper surface of the bottom surface member 14*b*, there is formed a protruding portion 32 having a substantially rectangular shape and protruding capable of fitting with the opening portion 22*a* of the bottom-projecting portion 22 of the inner container 12. Note that this protruding portion 32 is formed so as to be brought into close contact with the inner peripheral surface of the opening portion 22*a* in a case of being fitted with the opening portion 22*a*. The flange portion 36 is provided around the opening edge of the opening portion 14*a*, and this flange portion 36 is extended so as to have a length L1 toward an outer side in the radial direction of the opening (refer to FIG. 5B). Note that the length L1 is designed to be longer than a gap G1 between the convex portion 26-2*b* and the side surface member 12*c* in the flange portion 26 of the inner container 12 and to be shorter than a length L2 of the inner surface 26-1*a* of the extension portion 26-1. Accordingly, as illustrated in FIG. 5B, in a case where the flange portion 36 is fitted into the flange portion 26, the flange portion 36 cannot release a fitting state with the flange portion 26 easily by the convex portion 26-2*b* in the flange portion 26.

Figure 6A:
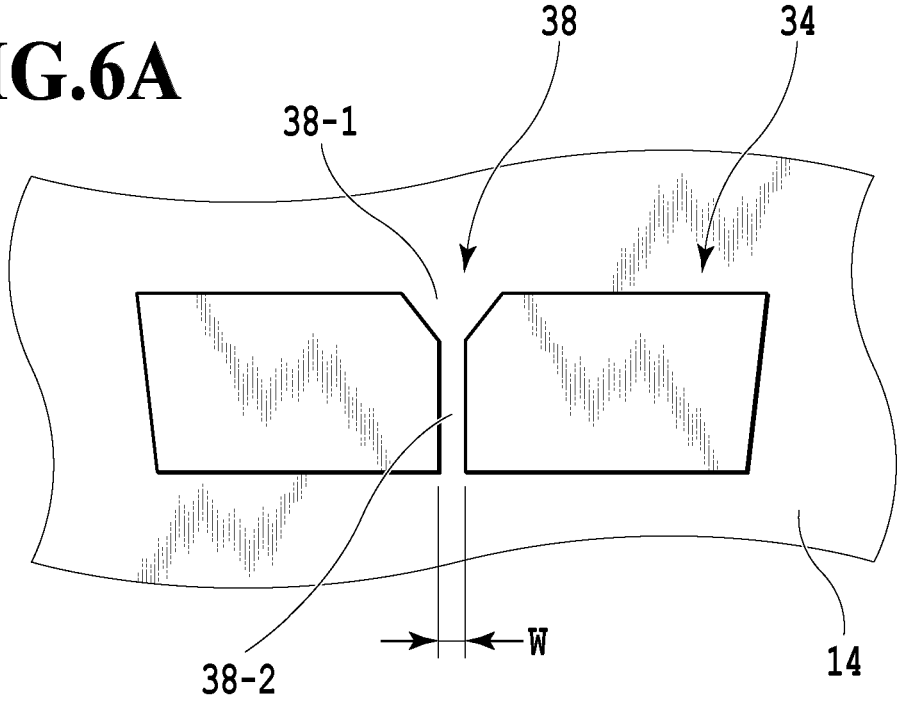
FIG. 6A is a front view of a rotation regulating member.
Figure 6B:
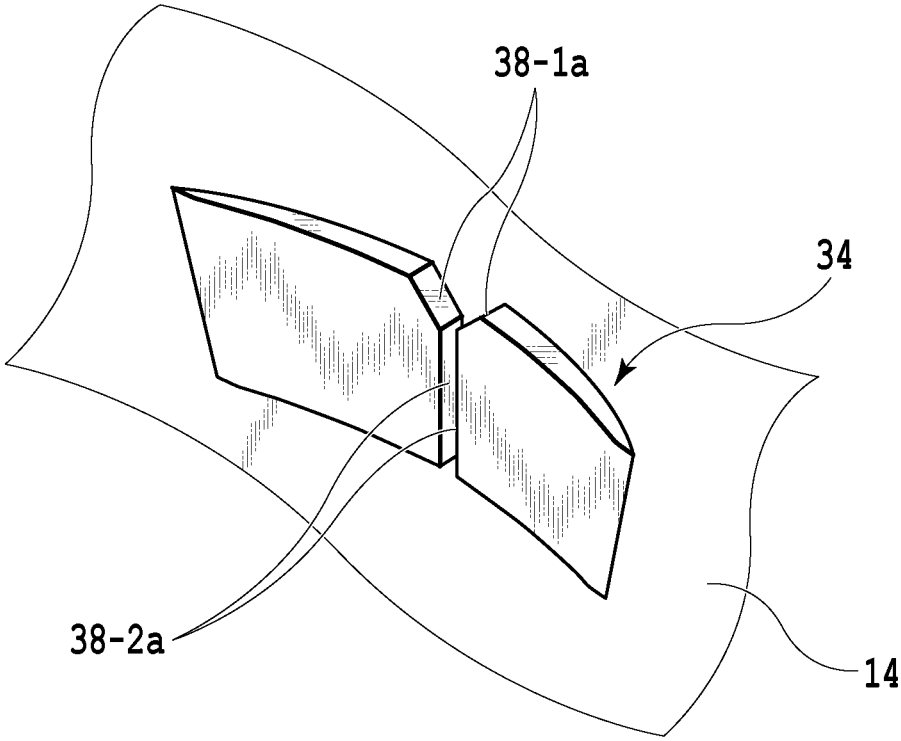
FIG. 6B is a schematic configuration perspective view of the rotation regulating member.

On the inner peripheral surface of the side surface member 14*c*, there are provided four rotation regulating members 34 (rotation regulating unit) capable of fixing the rib 24 of the inner container 12. Specifically, the rotation regulating member 34 is made of a pair of projections and is provided in the vicinity of an upper side in each of the arc shapes in the bottom surface member 14*b*, on the inner peripheral surface of the side surface member 14*c*, and in the case where the inner container 12 is attached to the outer container 14, there is provided a groove portion 38 capable of fixing the rib 24 disposed at a position passing through each of the arc-shaped central parts of the bottom surface member 12*b* in the inner container 12 (refer to FIGS. 6A and 6B). This groove portion 38 is constituted by having a guide portion 38-1 and a fixing portion 38-2.

The guide portion 38-1 is positioned on an upper side of the fixing portion 38-2 and is formed so that its width is reduced from the upper side to a lower side, and is constituted capable of guiding, to the fixing portion 38-2, the rib 24 disposed at the position passing through the arc-shaped central part of the bottom surface member 12*b* in the case where the inner container 12 is attached to the outer container 14. Namely, the lower end portion of the rib 24 positioned at the arc-shaped central part of the bottom surface member 12*b* is guided to the fixing portion 38-2 by moving in contact with inclined surfaces 38-1*a*.

In addition, there is formed the fixing portion 38-2, in a shape of groove having a width W, in which the rib 24 guided by the guide portion 38-1 is inserted and which is capable of sandwiching the inserted rib 24, namely, capable of fixing the rib 24 in contact with both surfaces of the rib 24 in a thickness direction. Furthermore, the fixing portion 38-2 is extended in the vertical direction, whereby in the case where the inner container 12 is to be attached to the outer container 14, there can be inserted the rib 24 disposed at the position passing through the arc-shaped central part of the bottom surface member 12*b*. As described above, since the fixing portion 38-2 has a configuration of sandwiching and fixing the rib 24, the fixing portion 38-2 is constituted capable of regulating relative rotation of the inner container 12 and the outer container 14. Namely, in the fixing portion 38-2, in the case where the inner container 12 and the outer container 14 are urged in a relatively rotating direction, a contact surface 38-2*a* of the fixing portion 38-2 with the rib 24 presses side surfaces (both surfaces in the thickness direction) of the rib 24 to thereby regulate the rotation.

In the aforementioned configuration, in the case where the inner container 12 is to be attached to the outer container 14, first, the inner container 12 is inserted into the side surface member 14*c* of the outer container 14 from the bottom surface member 12*b* side having a substantially rectangular shape, via the opening portion 14*a* of the outer container 14. The position of the inner container 12 in a rotating direction is roughly corrected by the inner peripheral surface of the side surface member 14*c* in which a portion closer to the bottom surface member 14*b* has a substantially rectangular shape along with the insertion of the inner container 12 into the outer container 14, and the arc-shape portion of the bottom surface member 12*b* is positioned in the vicinity of the upper side in the arc-shape portion of the bottom surface member 14*b*. After that, in a case where the rib 24 disposed at the position passing through the arc-shaped central part of the bottom surface member 12*b* reaches an upper end of the rotation regulating member 34, the lower end portion of the rib 24 moves to the fixing portion 38-2 while being guided by the guide portion 38-1 of the rotation regulating member 34, whereby the rib 24 is fixed while being sandwiched by the rotation regulating member 34. Then, by further insertion of the inner container 12, the opening portion of the bottom-projecting portion 22 of the inner container 12 is fitted with the protruding portion 32 of the outer container 14, and the flange portion 36 of the outer container 14 is fitted with the flange portion 26 of the inner container 12, with the result that attachment of the inner container 12 to the outer container 14 is completed.

Here, in the case where the inner container 12 is attached to the outer container 14, the movement of the inner container 12 in the separating direction from the outer container 14 is regulated by fitting between the flange portion 26 and the flange portion 36 and fitting between the opening portion 22*a* of the bottom-projecting portion 22 and the protruding portion 32. Furthermore, rotation of the inner container 12 with respect to the outer container 14 is regulated by the fitting between the opening portion 22*a* of the bottom-projecting portion 22 having a substantially rectangular shape and the protruding portion 32 and by fixing of the rib 24 disposed at the position passing through the arc-shaped central part of the bottom surface member 12*b* by the rotation regulating member 34. As described above, in the double container 10 constituted by the inner container 12 and the outer container 14, in the case where the inner container 12 is attached to the outer container 14, the relative rotation of the inner container 12 with respect to the outer container 14 is regulated. Accordingly, the inner container and the outer container become hardly separated as compared with the technologies (such as the technology disclosed in Japanese Utility Model Registration No. 2545154, for example) in which the relative rotation of the outer container and the inner container is suppressed by a friction force caused by the constituent members of the inner container and the outer container or contact between the constituent members provided at a predetermined interval.

Next, a manufacturing method of the inner container 12 and the outer container 14 will be described. The inner container 12 and the outer container 14 can make use of a conventionally known technology such as injection molding, for example. Note that, particularly, the outer container 14 is preferably molded by so-called injection in-molding in which a film obtained by printing a pattern is disposed in a die and the pattern printed on the film is transferred to a molded product by heat of a resin at injection molding at the same time as molding. By the use of the outer container 14 molded by such injection in-molding, there can be obtained such effects that the pattern is not distorted and a coloring property is excellent as compared with a pattern formed on the outer peripheral surface by, for example, printing, crimping of a film, or the like.

As described above, in the double container 10 according to the present invention, the bottom surface member 12*b* of the inner container 12 is made into a substantially rectangular shape with the four arc-shaped corner parts, and the bottom surface member 14*b* of the outer container 14 is made into a substantially rectangular shape with the four arc-shaped corner parts. In addition, on the outer peripheral surface of the inner container 12, the rib 24 is disposed in plural numbers at the predetermined intervals, and the ribs 24 are disposed at least at positions each passing through the central part of each of the arc shapes of the bottom surface member 12*b*. Furthermore, in the vicinity of the upper side in each of the arc shapes in the bottom surface member 14*b* on the inner peripheral surface of the outer container 14, there is disposed the rotation regulating member 34 capable of sandwiching and fixing the ribs 24 disposed at the positions each passing through the central part of each of the arc shapes of the bottom surface member 12*b*. Accordingly, in the double container 10 according to the present invention, the relative rotation of the inner container 12 and the outer container 14 is regulated by the ribs 24 fixed through the use of the rotation regulating member 34. Thus, in the double container 10 in which the inner container 12 is attached to the outer container 14, the inner container 12 and the outer container 14 become hardly separated. Furthermore, the inner container 12 can be fixed to the outer container 14 without welding.

Moreover, in the double container 10 according to the present invention, in the case where the inner container 12 is attached to the outer container 14, the opening portion 22*a* opened having a substantially rectangular shape by the bottom-projecting portion 22 in the inner container 12 and the protruding portion 32 having a substantially rectangular shape provided on the bottom surface member 14*b* of the outer container 14 are constituted to be brought into close contact with and fitted with each other. Accordingly, in the double container 10, the relative rotation of the inner container 12 and the outer container 14 is further regulated, and thus the separation between the inner container 12 and the outer container 14 becomes more difficult.

Furthermore, in the rotation regulating member 34, the guide portion 38-1 for guiding the rib 24 to the fixing portion 38-2 is formed on the upper side of the fixing portion 38-2 for sandwiching and fixing the rib 24. As a result, the rib 24 can be more easily sandwiched by the fixing portion 38-2, and thus workability is enhanced. Moreover, since the rotation regulating member 34 is formed at the position of the arc shape which is relatively difficult to be deformed in the side surface member 14*c* in the outer container 14, the rib 24 can be continuously sandwiched even in a case where the shape of the double container 10 is deformed by a force from an outside.

Note that the aforementioned embodiment may be modified as illustrated in (1) to (5) below:

(1) The disposed position of the rotation regulating member 34 is not limited to the vicinity of the upper side in each of the arc shapes of the bottom surface member 14*b*, and there may be accepted any position including the inner peripheral surface of the side surface member 14*c* of the outer container 14 as long as the rib 24 (including the rib not disposed at the position passing through the central part of the arc shape of the bottom surface member 12*b*) can be sandwiched by the fixing portion 38-2. Note that, in order to cope with the deformation of the double container 10 by a force from the outside, the rotation regulating member 34 is preferably disposed at the position where deformation by the force is difficult. Furthermore, the number of rotation regulating members 34 to be provided may be 1 to 3 or 5 or more, and it is sufficient that the rotation regulating member 34 is provided at a position where the relative rotation of the inner container and the outer container can be effectively regulated on the basis of the shapes of the bottom surface members 12*b* and 14*b*.

(2) The double container 10 is not limited to having the circular opening portions 12*a* and 14*a* and the substantially rectangular-shaped bottom surface members 12*b* and 14*b* with each of the four corner parts having an arc shape. Namely, it is sufficient that each of the inner container 12 and the outer container 14 has a non-circular cross section in at least a part in the vertical direction, and for example, the opening portion may not be true round. Furthermore, such non-circular cross section may have a substantial polygonal shape or an elliptic shape in which a corner portion of a polygon other than a square has an arc shape. Moreover, the opening portions 12*a* and 14*a* and the bottom surface members 12*b* and 14*b* may have the same shape as one another or may have different shapes from one another.

(3) The aforementioned embodiment is constituted such that the fixing portion 38-2 of the rotation regulating member 34 sandwiches the rib 24, but there may be a gap (so-called play) between the fixing portion 38-2 and the rib 24 to the extent that movement of the rib 24 in the rotating direction is allowed as long as the relative rotation of the inner container 12 and the outer container 14 is regulated within a range where a force in the separating direction of the inner container 12 and the outer container 14 is not generated by interference between the both (particularly, the interference between the outer peripheral surface of the inner container 12 and the inner peripheral surface of the outer container 14).

(4) A material to be used in molding the inner container 12 and the outer container 14 is not limited to polypropylene. Namely, various resin materials may be used in consideration of applications or manufacturing costs. Furthermore, conventionally known technologies such as the technology disclosed in Japanese Utility Model Registration No. 2545154 may be used as a configuration for regulating movement in the separating direction of the inner container 12 with respect to the outer container 14.

(5) The aforementioned embodiment and the modified examples illustrated in (1) to (4) above may be appropriately combined.

The present invention is suitably used as a cup-shaped container requiring an insulating effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A double container in a cup shape, having an inner container in which at least a part of a cross section is non-circular and an outer container in which at least a part of a cross section is non-circular, having a space provided between said inner container and said outer container, and having an open upper end portion, the container comprising:

on an outer peripheral surface of a cylindrical side surface member of said inner container, a rib extending in a vertical direction and disposed in plural numbers at predetermined intervals; and a rotation regulating unit disposed on an inner peripheral surface of a cylindrical side surface member of said outer container and capable of regulating relative rotation of said inner container and said outer container by interfering with said rib, wherein: said rotation regulating unit having a groove-shaped fixing portion extended in a vertical direction and sandwiching and fixing said rib, and a guide portion whose width decreases downward so as to guide said rib to said fixing portion, and the relative rotation of said inner container and said outer container is regulated by said rotation regulating unit within a range where a force in a separating direction of said inner container and said outer container is not generated by interference between the both.

2. The double container according to claim 1, wherein each of said inner container and said outer container has a circular opening portion formed on one side of a cylindrical side surface member and a substantially rectangular bottom surface member formed on the other side of the side surface member and having four arc-shaped corner parts.

3. The double container according to claim 2, wherein said rib is disposed at least at a position passing through a central part of each of the arc shapes in the bottom surface member in said inner container; and said rotation regulating unit is positioned in a vicinity of an upper side of the central part of each of the arc shapes of the bottom surface member in said outer container so as to interfere with said rib positioned at the central part of the arc shape of the bottom surface member in said inner container.

4. The double container according to claim 2, wherein a protruding portion having a substantially rectangular shape is formed on the bottom surface member of said outer container, and a projecting portion having a substantially rectangular shape capable of being fitted with said protruding portion is formed on the bottom surface member of said inner container.

5. The double container according to claim 2, wherein a circular opening portion formed on one side of a cylindrical side surface member of each of said inner container and said outer container is provided with a fitting portion fitted with each other so as to regulate movement in a separating direction from each other.

6. The double container according to claim 5, wherein the opening portion of said outer container has a flange portion extended outward in a radial direction around an opening edge, and the flange portion of said outer container is provided with a convex portion limiting removal by fitting the opening portion of said inner container within the convex portion.

7. The double container according to claim 6, wherein the opening portion of said inner diameter has a flange portion extended outward in a radial direction around an opening edge, and the flange portion of said inner container is fitted in the flange portion of said outer container to thereby limit movement in a depriving direction by said convex portion.

8. The double container according to claim 1, wherein each of said inner container and said outer container is formed with a region where the side surface members approach each other is formed around an opening on the opening portion side formed on one side of the cylindrical side surface member; and said rib extends to the approaching region to the side surface member of said outer container formed on the opening portion side of the side surface member of said inner container.

* * * * *